United States Patent [19]

Schmitz

[11] Patent Number: 4,500,875

[45] Date of Patent: Feb. 19, 1985

[54] DEVICE FOR DISPLAYING DIGITAL INFORMATION INCORPORATING SELECTION OF PICTURE PAGES AND/OR RESOLUTION ENHANCEMENT

[75] Inventor: Herman J. R. Schmitz, Eindhoven, Netherlands

[73] Assignee: U.S. Philips Corporation, New York, N.Y.

[21] Appl. No.: 346,702

[22] Filed: Feb. 8, 1982

[30] Foreign Application Priority Data

Mar. 19, 1981 [NL] Netherlands ..... 8101339

[51] Int. Cl.[3] ..... G09G 1/28

[52] U.S. Cl. ..... 340/703; 340/723; 340/799

[58] Field of Search ..... 340/799, 701, 703, 749, 340/750, 801, 723

[56] References Cited

U.S. PATENT DOCUMENTS 4,232,311 11/1980 Agneta ..... 340/701 X

FOREIGN PATENT DOCUMENTS 4197 9/1979 European Pat. Off. ..... 340/703

2847390 5/1980 Fed. Rep. of Germany ..... 340/703

*Primary Examiner*—Marshall M. Curtis

*Assistant Examiner*—Vincent P. Kovalick

*Attorney, Agent, or Firm*—Thomas A. Briody; William J. Streeter; Edward W. Goodman

[57] ABSTRACT

Digital information is usually displayed as a set of pixels which are arranged according to a line pattern within a two-dimensional area. For the storage of the information to be displayed, use is normally made of a picture memory. The content of an information pixel is stored in the memory as m bits (m>1). When use is made of a color map memory, the information can be displayed in different colors to be selected by a user. Selective display of the information is also possible, which means that only a selected number of the m bits are displayed. The invention provides a device for the display of digital information which enables selective display. In order to realize selective display, a device in accordance with the invention comprises a gate circuit with a control input on at least one connection between the display memory and the color map memory. Selective display in the form of picture pages and resolution enhancement is made possible by selected control signals on said control input.

8 Claims, 9 Drawing Figures

DEVICE FOR DISPLAYING DIGITAL INFORMATION INCORPORATING SELECTION OF PICTURE PAGES AND/OR RESOLUTION ENHANCEMENT

BACKGROUND OF THE INVENTION

The invention relates to a device for displaying digital information as a set of pixels which are arranged according to a line pattern in a two-dimensional area, comprising a display memory for the storage of the display information, the information containing m bits for each pixel ($m>1$), a data output of said display memory being connected to an address input of a programmable color map memory which comprises a data output for color information.

A device of this kind is known from British Patent Application No. 2,032,740.

The display memory and the color map memory of this device are controlled by means of a processor. A pixel on the screen of a display apparatus connected to the data output of the color map memory is formed by an m-bit data word from the display memory. This data word indicates an address in the color map memory. At this address a selected color is programmed, with the result that the pixel is displayed on the display apparatus in the selected color. Suitable programming of the color map memory enables the display apparatus to display the color information which is identified by only one or some of the m bits of the pixel. When used for the pixels of a picture to be displayed, this technique is referred to as picture page selection. Each picture page thus produced then has a depth of one or more bits. When another page is to be selected for display, it is necessary to completely reprogram the color map memory by means of the processor. This is a complex and time-consuming operation, particularly when the color map memory has a large content. In the described device it is also necessary to read the entire content of the color map memory in order to establish which page is displayed.

SUMMARY OF THE INVENTION

The invention has for its object to provide a device in which picture page selection is achieved without the color map memory being reprogrammed for each page selected. It is another object of the invention to realize resolution enhancement by means of the same device.

To this end, a device in accordance with the invention is characterized in that at least one connection between the data output of the display memory and the address input of the color map memory is provided with a gate circuit with a control input for passing, under the control of a first control signal, the m bits of the pixel to be displayed as a first address for the color map memory and for passing, under the control of a second control signal, a selectable part of the m bits of the pixel to be displayed as a second address for the color map memory. By selection of the bits associated with the selected picture page, that is to say by taking into account only the bit value of the selected bit and by assigning the same value to the non-selected bits, it is achieved that only the selected page is displayed and that another location in the color map memory is addressed. Resolution enhancement is obtained by selective display of the bits of each pixel.

A preferred embodiment of the device in accordance with the invention is characterized in that for each parallel connection, the gate circuit comprises at least one logic gate whose control input is connected to a control signal generator for passing, under the control of the second control signal, a first selectable part of the m bits of the pixel to be displayed and for passing, under the control of a third control signal, a second selectable part of the m bits of the pixel to be displayed, the first selectable part and the second selectable part being mutually exclusive.

The control signals generated by the control signal generator indicate which picture page (pages) is (are) displayed and/or which resolution enhancement is realized by the second and the third control signals.

A preferred embodiment of a device in accordance with the invention is characterized in that said control signals are invariable, during the duration of a picture to be displayed, for the display, under the control of the first control signal, of a first page having a data content of m bits per pixel, and for the display, under the control of the second control signal of at least one second page having a data content of b bits per pixel, b being smaller than m. A simple device for picture page selection is thus realized.

Another embodiment of a device in accordance with the invention is characterized in that said second and third control signals for a parallel connection of m logic gates, one gate being provided for each connection, are in phase with the period in which a pixel is presented to said parallel connection, said period comprising at least two non-overlapping subperiods, the second control signal being active only during a first subperiod and the third control signal being active only during a second subperiod. A simple device for resolution enhancement in the horizontal direction is thus realized.

A further preferred embodiment of a device in accordance with the invention is characterized in that said second and third control signals for a first parallel connection of m logic gates, one gate being provided for each connection, are in phase with the frame period of a frame pattern, the second control signal being active only during the period of a first frame and the third control signal being active only during the period of a second frame. A simple device for resolution enhancement in the vertical direction is thus realized.

Another preferred embodiment of a device in accordance with the invention is characterized in that the gate circuit comprises at least one second parallel connection of m logic gates, said first and said second parallel connection being connected in series, a fourth and a fifth control signal for the second parallel connection being in phase with the period in which a pixel is presented to the second parallel connection, said period comprising at least two non-overlapping subperiods, the fourth control signal being active only during the first subperiod and the fifth control signal being active only during a second subperiod in order to pass, under the control of the fourth control signal, a third selectable part of the m bits of the pixel to be displayed and in order to pass, under the control of the fifth control signal, a fourth selectable part of the m bits, said third and fourth selectable parts being mutually exclusive. Thus, a device for a resolution enhancement in the horizontal and the vertical direction is realized.

Another preferred embodiment of a device in accordance with the invention is characterized in that the control signal generator is a memory which can be addressed in phase with the period in which a pixel is presented to the gate circuit and/or with the period of a frame pattern in order to generate second and third control signals during these periods.

Thanks to the use of a memory as the control signal generator, a simple device is realized for picture page selection as well as resolution enhancement.

DESCRIPTION OF THE DRAWINGS

The invention will be described in detail hereinafter with reference to the accompanying drawings, in which.

DESCRIPTION OF THE PREFERRED EMBODIMENT

Figure 1:
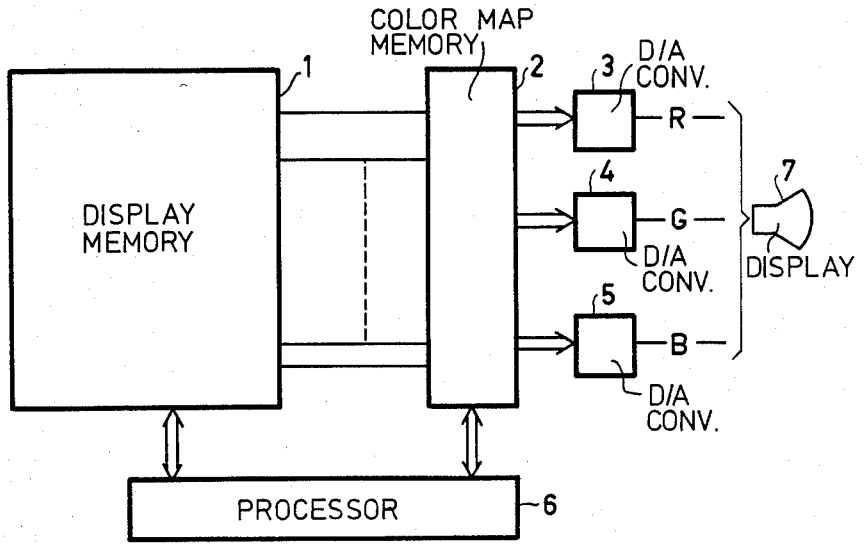
FIG.1 PRIOR ART
FIG. 1 shows a device for the display of digital information in accordance with the present state of the art.

FIG. 1 shows a device for the display of digital information according to the present state of the art in which color possibilities can be exchanged against picture pages. Picture pages will be referred to hereinafter as pages for the sake of simplicity.

The reference numeral 1 denotes a display memory for the storage of information to be displayed; the reference numerals 3, 4 and 5 denote digital-to-analog converters. Element 2 is a color map memory. The color map memory 2 is controlled by a processor 6 which also controls the display memory 1; element 7 is a display apparatus.

A system with a resolution of X pixels in the horizontal direction and Y pixels in the vertical direction and m bits per pixel requires a storage capacity C=X.Y.m. A pixel on the screen of the display apparatus 7 is stored in the display memory 1 in the form of a data word of m bits. The m-bit data word forms an m-bit address which indicates a location in the color map memory 2. A color is programmed at this location in the color map memory 2. Thus, using such an m bit data word, $2^m$ locations in the color map memory 2 can be indicated, implying $2^m$ selection possibilities. The color map memory 2 is a random-access-memory which can be programmed by means of the processor 6. The word in the color map memory 2 has a width of n bits (n>1), so that a selection from $2^n$ colors is possible. Preferably, n is a multiple of three (n=3k) for division of n into k bits red, k bits blue and k bits green. It is possible to reprogram the color map memory 2 for each picture. Because a location in the color map memory 2 is addressed by an m-bit data word from the display memory 1, there are restrictions as regards the number of colors to be selected. Thus, if m<n, only $2^m$ feasible colors of the $2^n$ colors of the color map memory 2 can be indicated, and if m>n, different addresses indicate the same color.

It is possible to exchange color possibilities against pages without modification of the content of the display memory 1. If there are m bits per pixel in the display memory 1, the display memory may be considered to consist of a maximum of m pages having a depth of 1 bit each. Evidently, other combinations are also possible if the following relation is satisfied:

$$\sum_i (a_i \text{ pages} \times b_i \text{ bits}) \leqq m$$

in which $a_i$ and $b_i$ represent numbers and i is the number of groups of pages. Such a page of the $i^{th}$ group then has $2^{b_i}$ color possibilities. For example, if a pixel of the display memory comprises five bits, it is possible to display 1 page×2 bits plus 2 pages×1 bit on the display apparatus. For the two 1-bit pages, two colors are then possible for each page and for the 2-bit page, four colors are possible, the remaining fifth bit represents a page which is not displayed. Page selection is obtained in accordance with the state of the art by programming the color map memory 2 in a special manner. The color map memory 2 is then programmed so that only the bits from the pages to be displayed activate the digital-to-analog converters 3, 4 and 5.

Figure 2A:
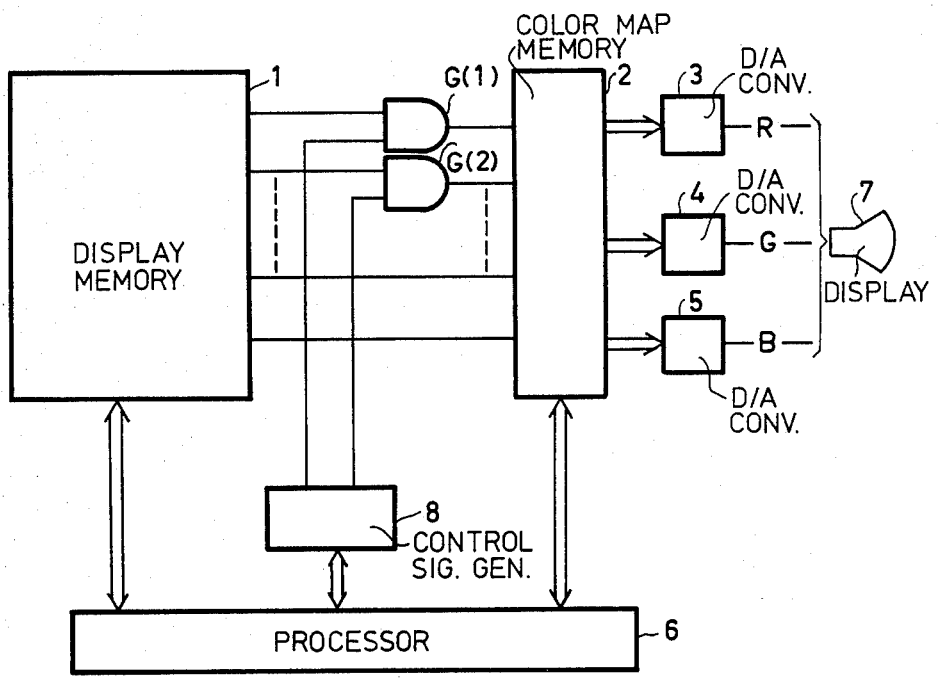
FIG. 2*a* illustrates the idea of the invention for a device for the display of digital information.

FIG. 2*a* illustrates the idea of the invention in a device for the display of digital information in which color possibilities can be exchanged against pages as well as against enhancement of resolution. At least one connection between the display memory 1 and the color map memory 2 in this device comprises a gate circuit. The gate circuit comprises at least one logic gate G which has a control input which is connected to a control signal generator 8. The control signal generator 8 generates control signals under the influence of which the gate circuit operates in the passing or the blocking mode. When the gate circuit is in the passing mode, the data word on the data output of the display memory 1 is the same as the address word applied to the color map memory 2. However, when the gate circuit is in the blocking mode under the influence of a control signal on the control input, the address word deviates from the data word and, consequently, a different location of the color map memory 2 is addressed, with the result that a shift takes place in the color map memory 2 and the information of the relevant bit which is blocked by the gate circuit is not displayed. Page selection is realized by means of control signals which are statically activated on the control input of the control signal generator. The control signals can also be dynamically activated, which means that they are in phase with the period in which the pixels are applied to the gate circuit and/or with the period of the frames for frame-wise display; the resolution of the picture to be displayed is then enhanced.

Figure 2B:
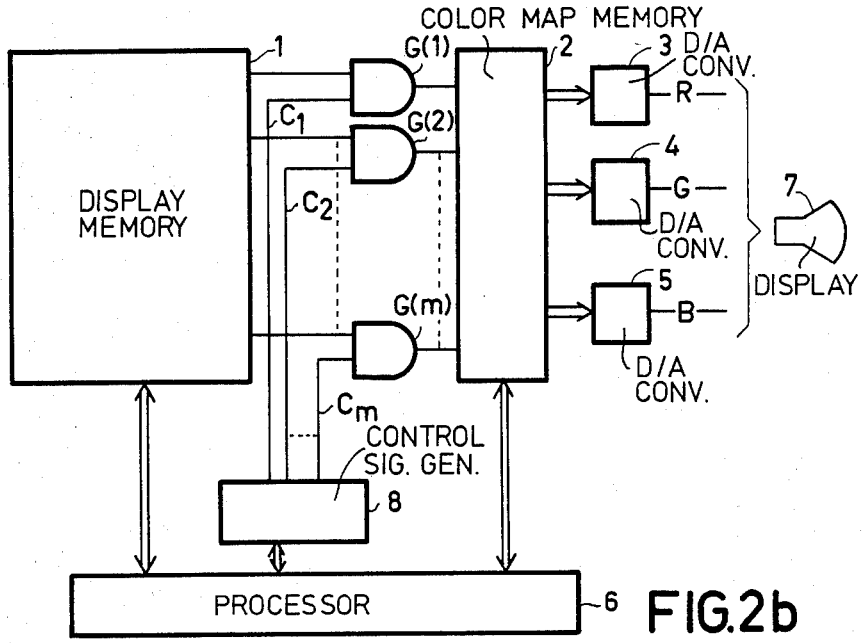
FIG. 2*b* shows a preferred application of the idea of the invention in such a device.

FIG. 2*b* shows a preferred embodiment of a device in accordance with the invention in which color possibilities are exchanged against pages, without it being necessary to reprogram the content of the color map memory 2. The elements which correspond to those shown in FIG. 1 are denoted by the same reference numerals.

Each connection in this preferred embodiment between the data output of the picture memory 1 and the address input of the color map memory 2 comprises a gate circuit, said gate circuit comprising a logic AND-gate (G). There are m parallel connections for passing one bit per connection per pixel of m bits to be displayed. Thus, there are m logic AND-gates G(1), . . . G(m) which form a parallel circuit.

The control lines $C_1, \ldots C_m$ are connected to outputs of a buffer (PIA=peripheral interfate adapter, Motorola MC 6820) which, in its turn, is connected to the microprocessor 6 and acts as the control signal generator 8.

Selection of one or more pages is realized by means of a control signal on the control lines $C_1$ to $C_m$ which is statically activated, static in this respect being understood to mean that the control signal is invariable during the duration of a picture to be displayed. A control signal is to be understood to mean herein a set of m signals, one on each control line. A selected number of logic AND-gates G(i) changes to the passing mode when such a control signal is applied. A selection of another page or pages is simply realized by modification of the content of the buffer 8, so that another control signal having another content is applied to the control lines $C_1$ to $C_m$. In this embodiment the selection of a page is determined by one variable, that is to say the bit value of the control signal on the associated control line $C_i$. In order to establish which page (pages) of the memory is (are) displayed on the screen of the display apparatus 7, it is sufficient to read the content of the buffer 8.

The data word formed on the output of the parallel connection of logic gates $G_1, \ldots G_m$ is an address for the color map memory 2. A color is programmed at this address in the color map memory 2. For example, for the display of one page having a depth of 3 bits and one page having a depth of 1 bit, a selection from $2^3=8$ color possibilities exists for the page having a depth of 3 bits and from $2^1=2$ (for example, black and white) color possibilities for the page having a depth of 1 bit.

When several pages are simultaneously displayed, the color of the common pixels on the screen of the display apparatus 7 is determined by the content of the color map memory 2. There are two control modes, i.e. "overlay" and "mixed".

Figure 3:
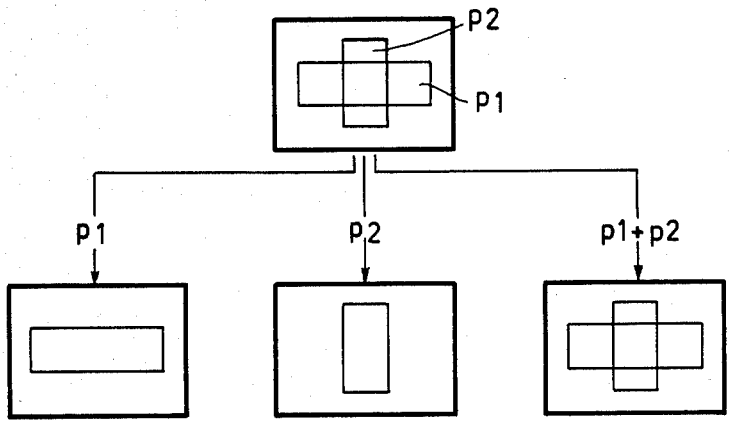
FIG. 3 shows an example of display of page pictures in the "mixed" mode.

FIG. 3 shows one example of the mode "mixed". For example, assume that the color map memory 2 is programmed in accordance with the table below and that the pixels from the display memory have a depth of 4 bits (m=4).

| ADDRESS color map memory 2 | PAGE from the memory P | COLOR in color map memory 2 at selected address |
|---|---|---|
| 0000 | none | black |
| 0001 | 1 | red |
| 0010 | 2 | green |
| 0011 | 1 + 2 | yellow |

Also assume that a picture consists of two mutually perpendicular bars and that the memory is divided into pages, such that for example, the horizontal bar is present on a first page and a second page contains the vertical bar. If only the signal on, for example, the first control line $C_1$ is high (p1, address 0001) and low on all other control lines, only the first page is displayed. On the screen of the display apparatus 7 a red horizontal bar then appears on a black background. The black background is formed in that all other connection lines carry a low signal, so that the location 0000 (black) of the color map memory 2 is addressed for the pixels which do not form part of the horizontal bar. If only the signal on, for example, the second connection line $C_2$ is high (p2, address 0010), a green vertical bar is displayed on a black background on the screen. If, for example, both connection lines $C_1$ and $C_2$ carry a high signal (p1+p2=p1+2, address 0011), two mutual perpendicular bars are displayed on the screen of the display apparatus, the overlapping part thereof having a yellow color while the horizontal end segments are red and the vertical end segments are green.

Figure 4:
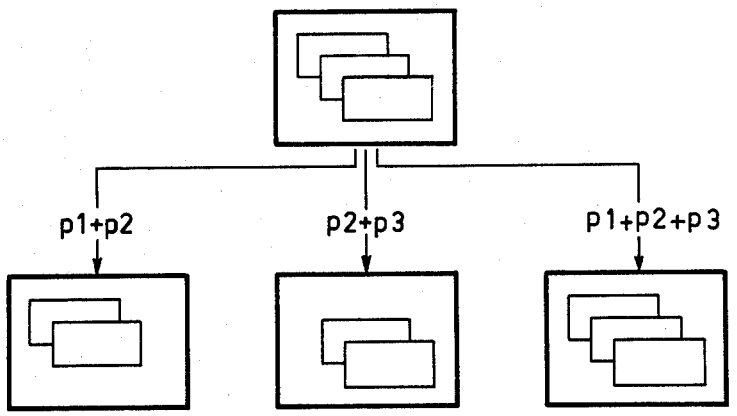
FIG. 4 shows an example of the display of page pictures in the "overlay" mode.

FIG. 4 shows an example of the "overlay" mode. Assume, for example, that the color map memory 2 is programmed in accordance with the table below.

| ADDRESS | PAGE p | COLOR | ADDRESS | PAGE p | COLOR |
|---|---|---|---|---|---|
| 0000 | 0 | black | 0100 | 3 | blue |
| 0001 | 1 | red | 0101 | 3+1 | blue |
| 0010 | 2 | green | 0110 | 3+2 | blue |
| 0011 | 1+2 | green | 0111 | 3+2+1 | blue |

Also assume that the picture consists of three overlapping rectangles, each of which is present on one page of the display memory 1. Priorities can be assigned to given pages by suitable programming of the color map memory 2. When p1+p2=p1+2, address 0011 (signal high on, for example control lines $C_1$ and $C_2$) is displayed, green is the color having the highest priority (0010 and 0011), so that a part of the first page (p1, address 0001, red) is overlapped by the second page (p2, address 0010, green). When p2+p3=p2+3, address 0110, is displayed, blue is the color having the highest priority (0100 and 0110), so that a part of the green page is overlapped by the blue page. When all three pages are simultaneously displayed (p1+p2+p3=p3+2+1, address 0111), blue is the dominant color (0100 and 0111).

The device in accordance with the invention can also be used for exchanging color possibilities against enhancement of resolution. The resolution can be enhanced in the horizontal as well as in the vertical direction. A capacity C=XY.m for the display memory (X pixels horizontally, Y pixels vertically, m bits per pixel) is subdivided as C=aX by (m/ab) when the horizontal resolution is enhanced from X to Ax (where a $\epsilon$N) and the vertical resolution from Y to bY (where b$\epsilon$N).

In that case $2^{m/ab}$ color possibilities remain for a pixel to be displayed. It is alternatively possible to enhance the resolution only in the horizontal direction or only in the vertical direction or to obtain a combination of resolution enhancement and page pictures. For example, if X=Y=256 pixels and m=8 bits, inter alia the following combinations are possible for resolution enhancement:

| | |
|---|---|
| C = (256) × (256) × 8 | normal situation |
| C = (2×256) × (2×256) × 2 | doubling horizontal and vertical |
| C = (2×256) × (256) × 4 | doubling horizontal |
| C = (256) × (2×256) × 4 | doubling vertical. |

The enhancement in the vertical direction is limited by the number of TV lines used for the display of one pixel. Usually, one line per frame is used in apparatus operating with a frame pattern.

Figure 5:
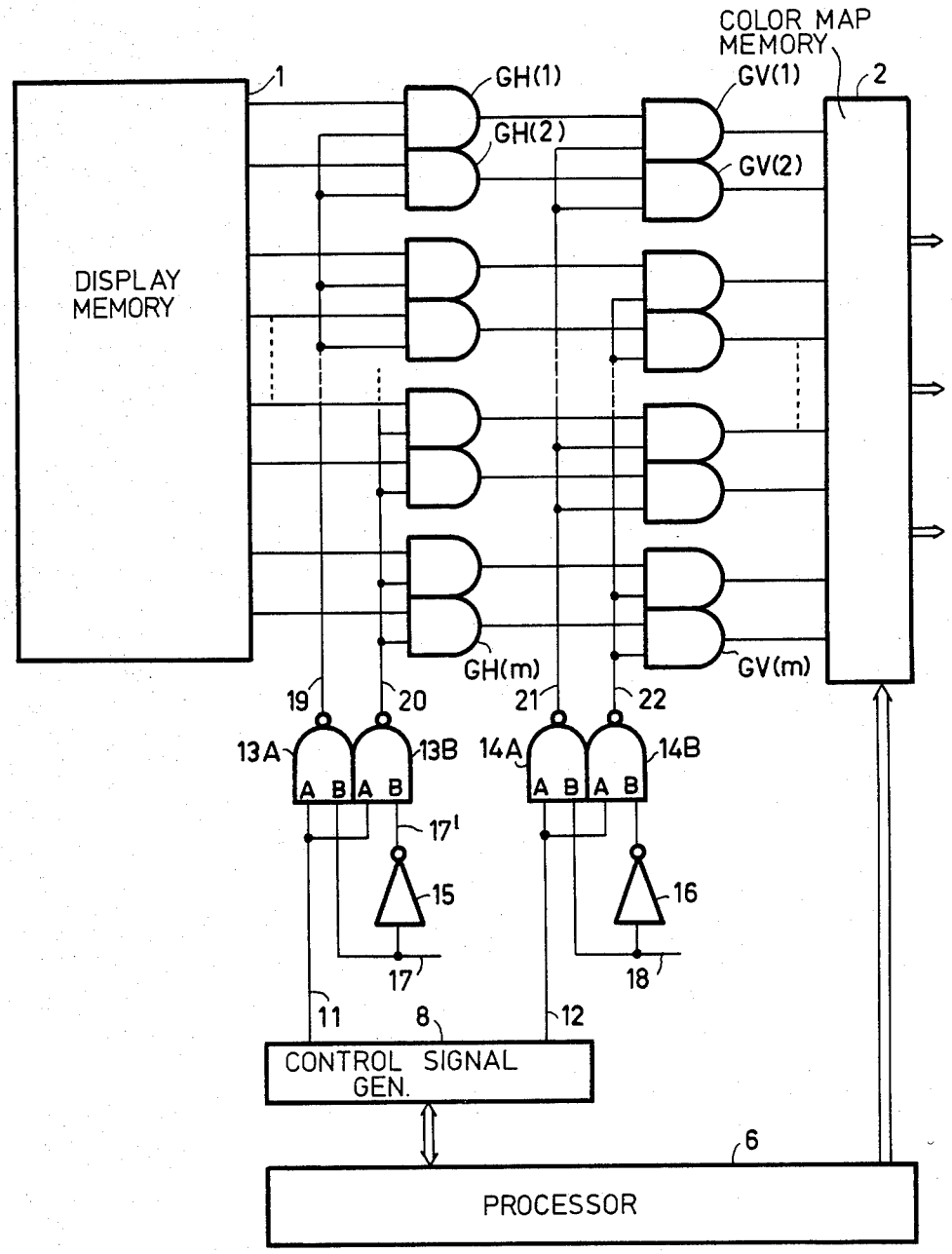
FIG. 5 shows an embodiment of device for the display of digital information with resolution enhancement facility.

FIG. 5 shows an embodiment of a device for the display of digital information in which color possibilities are exchanged against doubling of the resolution in the horizontal as well as the vertical direction.

The data output of the display memory 1 is connected to the address input of the color map memory 2 via m parallel connections. Each connection comprises a first logic AND-gate GH and a second logic AND-gate GV which are connected in series, which means that an output of the first logic AND-gate GH is connected to an input of the second logic AND-gate GV. All first logic AND-gates GH(1), GH(2), . . . GH(m) of all m connections form a first parallel connection and all second logic AND-gates GV(1), or GV(2), . . . GV(m) form a second parallel connection.

The doubling of the resolution in the horizontal direction is realized by means of control signals on the control lines 19 and 20. The control line 19 is connected to the control inputs of a first half, GH(1) to GH(m/2) of the logic AND-gates of the first parallel connection; the control line 20 is connected to the control inputs of a second half, GH (m/2+1) to GH(m), of the logic AND-gates of the first parallel connection. It is assumed that m is an even number. If m is an odd number, a different number of colors exist for the two parts. The control lines 19 and 20 are connected to respective outputs of logic NAND-gates 13A and 13B. A first input (input A) of the logic NAND-gates 13A and 13B is connected to a connection line 11 which carries a signal ENH (enable horizontal) from the buffer 8. The presence of the signal ENH on the connection line 11 activates the doubling of the resolution in the horizontal direction. For the doubling of the resolution in the horizontal direction, the control signals on the control lines 19 and 20 must be synchronized with the pixel frequency. To this end, the pixel frequency signal is applied directly to a second input (input B) of the logic NAND-gate 13A via the connection line 17 and, via an inverting gate 15, to a second input of the logic NAND-gate 13B. Pixel frequency is to be understood to mean herein the frequency at which the m bits of the pixel to be displayed are applied to the input of the gate circuit, being the first parallel connection in this embodiment. Because the frequency and the period are related as known from physics, the description can also be given on the basis of the period in which the m bits of the pixel to be displayed are applied to the input of the gate circuit. The control signals for enhancement of the resolution in the horizontal direction must then be in phase with the period.

Thus, for example, in the first half of the period, the pixel frequency signal is high on a second input (input B) of the gate 13A and during the second half of the period, the signal is high on a second input of the gate 13B. The following table shows the output signal on the gates 13A and 13B.

| GATE | 13A | | | 13B | | | |
|---|---|---|---|---|---|---|---|
| | ENH A | B | $\overline{A \Omega B}$ | ENH A | B | $\overline{B}$ | $\overline{A \Omega \overline{B}}$ |
| LINE | 11 | 17 | 19 | 11 | 17 | 17' | 20 |
| | 0 | 0 | 1 | 0 | 0 | 1 | 1 |
| | 0 | 1 | 1 | 0 | 1 | 0 | 1 |
| | 1 | 0 | 1 | 1 | 0 | 1 | 0 |
| | 1 | 1 | 0 | 1 | 1 | 0 | 1 |

If no resolution enhancement in the horizontal direction is desired (A="0" or ENH="0"), the outputs of the NAND-gates 13A and 13B are always high ("1"), regardless of the signal on the inputs B of 13A and 13B. Thus, all AND-gates GH(1) to GH(m) are conductive and $2^m$ color possibilities exist for each pixel, at least if no resolution enhancement in the vertical direction is realized. When the resolution in the horizontal direction is doubled (A="1", signal ENH on connection line 11), NAND-gate 13B is conductive, $$(\overline{A \Omega \overline{B}} = 1),$$

when the pixel frequency signal is high (B="1"), for example, during the first half period. As a result, the gates GH(m/2+1) to GH(m) are conductive. In the color map memory 2, the location is addressed whose address is composed of m/2 zeroes and m/2 bits of the m-bit data word on the output of the display memory 1 (00 . . . 0, xx . . . x). When the pixel frequency signal becomes low, (B="0", $\overline{B}$="1"), for example, during the second half of the period, the NAND-gate 13A becomes conductive $$(\overline{A \Omega B} = 1)$$

and, consequently, the gates GH(1) to GH(m/2) are conductive. The location having the address composed of the remaining m/2 bits of the m-bit data word and the m/2 zeroes of the color map memory 2 is then addressed (xx . . . x, 00 . . . 0). For the color of the picture, it is necessary that the two addresses thus formed indicate the same color; otherwise, the pixel displayed has two different colors. For the color map memory 2, this implies that the same color must be programmed at both addresses (00 . . . 0xx . . . x) and (xx . . . x00 . . . 0).

The doubling of the resolution in the vertical direction is based on a similar principle. Doubling in the vertical direction is activated by a signal ENV (enable vertical) on the control line 12. Resolution enhancement in the vertical direction must be synchronized with the frame frequency or be in phase with the picture period of a frame pattern. Therefore, the frame frequency is presented on the control line 18. Because a video picture consists of an even and an odd frame, it is important that at the outputs of the NAND-gates 14A and 14B, the control lines 21 and 22 are connected to the correct logic AND-gates GV(i) of the second parallel connection. This device also enables quadrupling of the resolution, either in the horizontal or in the vertical direction, if possible in view of the frame pattern. It is then necessary to present the suitable frequency signals on the control lines 17 and 18 and the associated enable signals on the control lines 11 and 12. The meaning of the term "suitable" in this context will be described with reference to FIG. 6.

Figure 6:
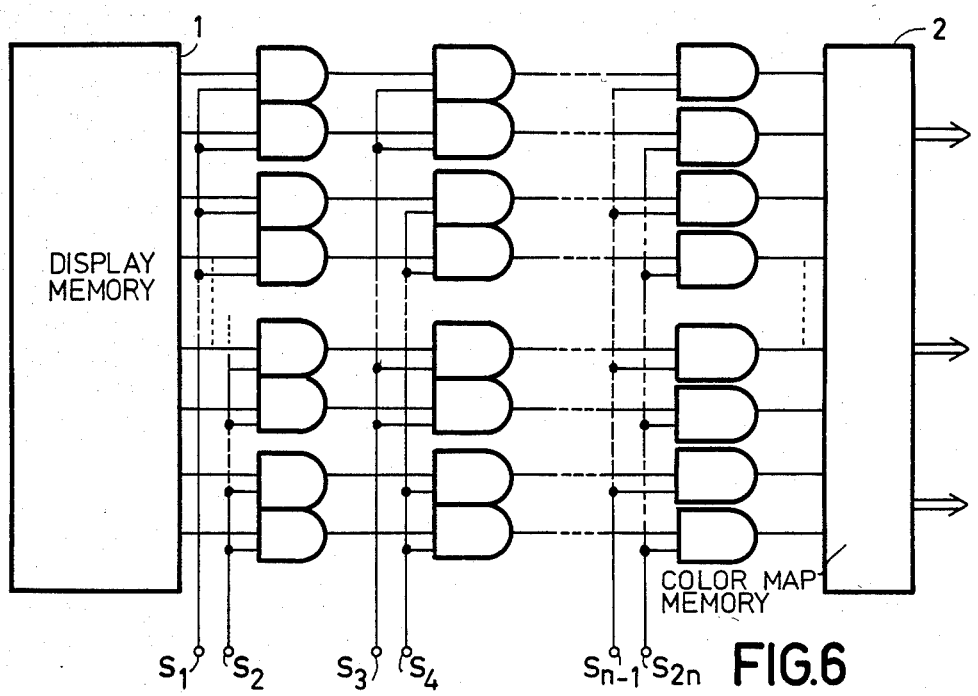
FIG. 6 shows a further embodiment of a device for the display of digital information with resolution enhancement facility.

FIG. 6 shows an embodiment of a device for exchanging color possibilities against a feasible and permissible resolution enhancement. This device is particularly suitable if m is a positive power of two, $m=2^m$; the system then comprises n parallel connections of m logic gates. The lines $S_1$ to $S_{2n}$ are control lines which carry control signals. These control signals are synchronized in time with the pixel frequency or an integral multiple thereof for resolution enhancement in the horizontal direction (suitable frequency signals). For resolution enhancement in the vertical direction, the control signals are synchronized in time with the frame frequency. Resolution enhancement in the vertical direction is limited by the number of TV lines used per frame; therefore, if only two TV lines are used, one for the even and one for the odd frame, the resolution can only be doubled in the vertical direction.

A multiple of the pixel frequency is obtained, for example, by multiplying the pixel frequency by a suitable factor by means of a multiplier or, if the pixel frequency is derived from a signal of higher frequency, by division of said signal of higher frequency.

Figure 7:
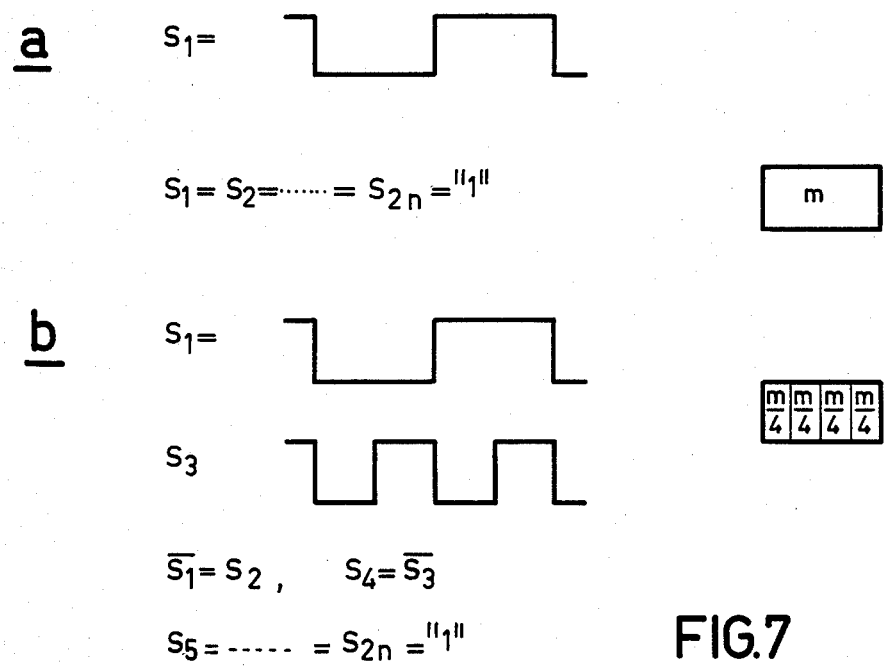
FIG. 7 shows some examples of resolution enhancement by means of such a device.
Figure 7:
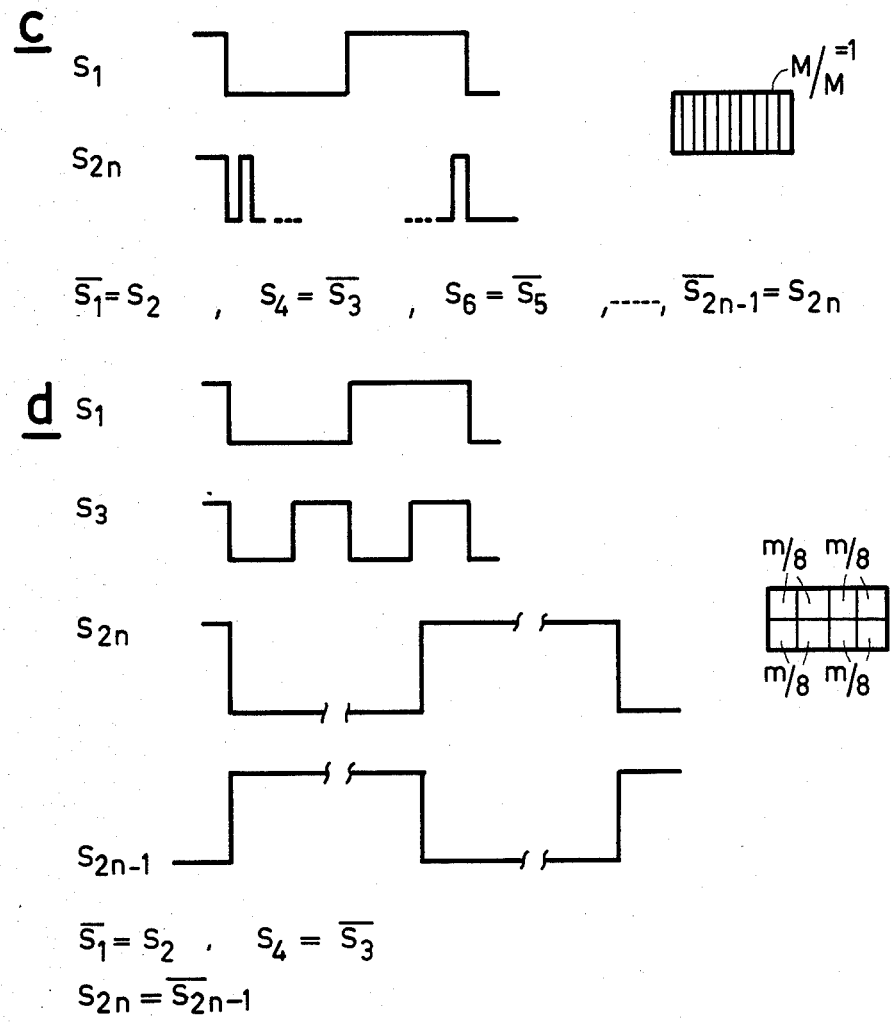

FIG. 7 illustrates some examples of resolution enhancement which can be realized by means of a device as shown in FIG. 6.

(a) If the signal on all lines $S_i$ is the same, i.e. $S_1=S_2 \ldots =S_{2n}=$"1", there is no resolution enhancement and there are $2^m$ color possibilities.

(b) If the pixel frequency is increased by a factor 4 and four times, the pixel frequency is applied to the lines $S_3$ and $S_4$ in such a form that $\overline{S}_3=S_4$, and two times the pixel frequency is applied to the lines $S_1$ and $S_2$ in such a form that $\overline{S}_1=S_2$, and further to all other $S_i(i>4)$, so that $S_i(i>4)=$"1", the resolution is increased by a factor 4 in the horizontal direction and there are $2^{m/4}$ color possibilities.

(c) If the pixel frequency is increased by a factor m and m times the pixel frequency is applied to the lines $S_{2n}$ and $S_{2n-1}$ in such a form that $$\overline{S_{2n-1}} = S_{2n},$$

m/2 times the pixel frequency to the lines $S_{2n-2}$, $S_{2n-3}$ in the form $$\overline{S_{2n-3}} = S_{2n-2},$$

and so on, so that $$\frac{m}{\frac{m}{2}} = 2 \times \text{pixel frequency}$$

is applied to the lines $S_1$ and $S_2$ in the form $$S_2 = \overline{S_2},$$

the resolution is enhanced by a factor m in the horizontal direction, and only two color possibilities remain.

(d) In this example, the resolution in the horizontal direction is quadrupled and doubled in the vertical direction. Four times the pixel frequency is applied to the lines $S_3$ and $S_4$ $$(\overline{S_3} = S_4)$$

and twice the pixel frequency to the lines $S_1$ and $S_2$ $$(\overline{S_1} = S_2)$$

in order to quadruple the resolution in the horizontal direction. The frame frequency is applied to the lines $S_{2n}$ and $S_{2n-1}$ in the form $$S_{2n} = \overline{S_{2n-1}}$$

in order to double the resolution in the vertical direction. In that case $2^{m/8}$ color possibilities exist.

Figure 8:
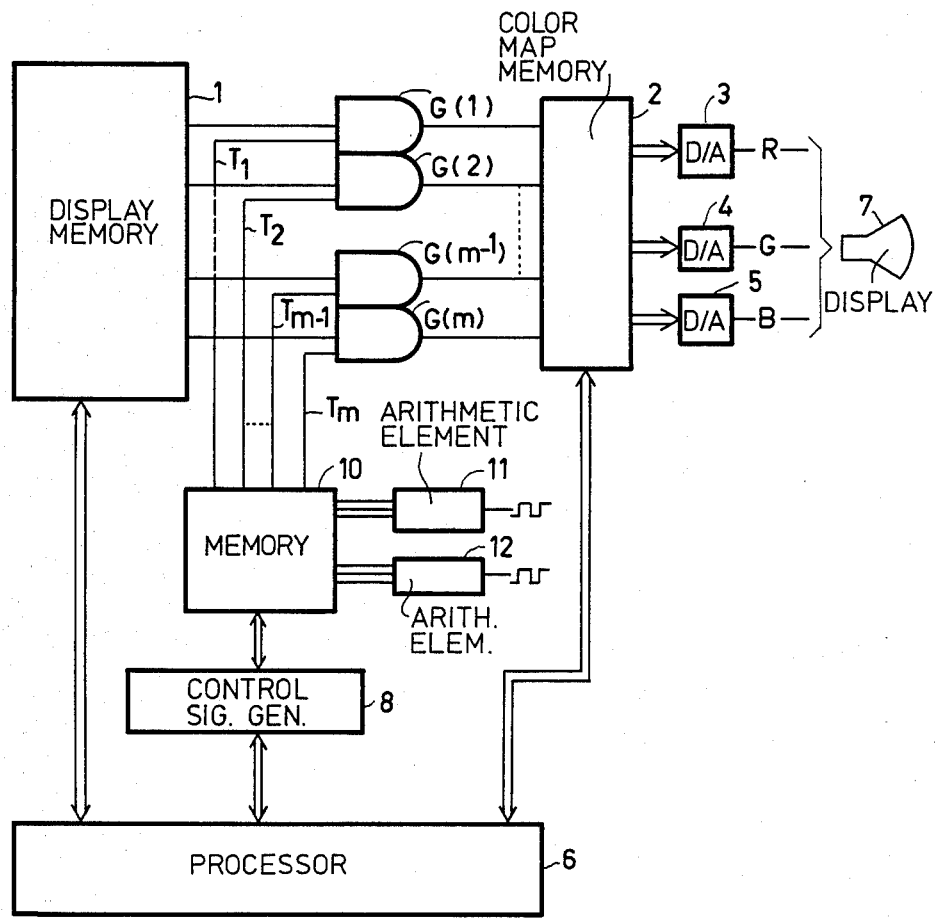
FIG. 8 shows a general solution for picture page selection and resolution enhancement in a device for the display of digital information.

FIG. 8 shows a general solution for the exchange of color possibilities against resolution and/or pages. Elements which correspond to elements of FIG. 2 are denoted by the same reference numerals.

The element 10 is a memory, for example, a read-only memory or a PLA (programmable logic array). The elements 11 and 12 are arithmetic elements, for example, a multiplier or divider which ensure that the pixel frequency signal, or a suitable multiple thereof, and the frame frequency, or a signal derived from the frame frequency, are applied to an input of the memory 10.

A selection of pages, or the selection from feasible resolution enhancements in the horizontal direction, the vertical direction, or a combination in the horizontal and the vertical direction, is then merely a matter of indicating the appropriate memory address containing the suitable pixel frequency and the frame frequency signal. A selected possibility is stored at a given address in the memory 10. Using the buffer 8, an address of the memory 10, at which the selected possibility is programmed, is addressed. A control signal for the logic AND-gates G(1), G(2), . . . G(m) is then outputted on the data output of the memory 10. The connection lines T(1), T(2), . . . T(m) connect the data output of the memory 10 to the second inputs of the logic gates.

For pages selection, the memory 10 is statically activated, which means that the control signals are independent of the pixel frequency and the frame frequency. For the selected pages, the associated logic gates G(i) are conductive under the influence of the selected control signal, programmed at the selected address.

For resolution enhancement, the memory 10 is dynamically activated, which means that the control signals are synchronized with the associated, suitable pixel frequency and/or frame frequency.

What is claimed is:

1. A device for arranging digital information as a set of pixels which are displayed according to a line pattern in a two-dimensional area, said device comprising:

a display memory for the storage of said digital information, an m-bit (m>1) information word being stored for each of said pixels to be displayed, said display memory comprising a data output for outputting said m-bit information words;

a programmable color map memory for the storage of color information, said color map memory having a data output for outputting color information and an address input;

means for generating control signals;

means for connecting said data output of said display memory to said address input of said programmable color map memory, said connecting means comprising at least one connection line having a gate circuit including a first gate input connected to said data output of said display memory, a gate output connected to said address input of said programmable color map memory, and a control input connected to said generating means for receiving control signals, said gate circuit passing to said gate output, under the control of a first control signal applied at said control input, a first address comprising the m-bit information word to be displayed, said gate circuit also passing to said gate output, under the control of a second control signal applied at said control input, a second address comprising a selectable part of the m-bit information word to be displayed.

2. A device as claimed in claim 1, wherein said connecting means comprises m parallel connection lines for passing one bit per connection line for each information word to be displayed, each of said connection lines being provided with a respective gate circuit, each gate circuit comprising at least one logic gate having a control input connected to said generating means, said logic gates passing, under the control of said second control signal, said second address comprising a first selectable part of the m-bit information word to be displayed, and passing, under the control of a third control signal, a third address comprising a second selectable part of the m-bit information word to be displayed, the first and the second selectable parts being mutually exclusive.

3. A device as claimed in claim 1 or 2, wherein a set of pixels displayed in said two-dimensional area forms a page picture, said control signals being invariable in the duration of a page picture to be displayed, for the display, under the control of said first control signal, of a first page picture having a data content of m bits per pixel, and for the display, under the control of said second control signal, of at least one second page picture having a data content of b bits per pixel, b being smaller than m.

4. A device as claimed in claim 2, wherein said second and said third control signals are in phase with the period in which an information word is presented to said logic gates, said period comprising at least two non-overlapping subperiods, said second control signal being active only during a first subperiod and said third control signal being active only during a second subperiod.

5. A device as claimed in claim 2, wherein a set of pixels displayed in said two-dimensional area forms a page picture which is to be displayed in picture pattern with at least two interlaced fields, said second and said third control signals being in phase with the field period of a picture pattern, said second control signal being active only during the period of a first field and said third control signal being active only during the period of a second field.

6. A device as claimed in claim 5, wherein said gate circuit for each connection line comprises at least a first and a second logic gate which are connected in series, said second and said third control signals being applicable to the control input of said first logic gates, a fourth and a fifth control signal generated by said generating means being applicable to the control input of said second logic gates, said fourth and said fifth control signals being in phase with the period in which an information word is presented to said second logic gates, said period in which an information word is presented comprising at least a first and a second non-overlapping subperiod, said fourth control signal being active only during said first subperiod and said fifth control signal being active only during said second subperiod in order to pass, under the control of said fourth control signal, a third selectable part of the m-bit information word to be displayed and in order to pass, under the control of said fifth control signal, a fourth selectable part of the m-bit information word, said third and fourth selectable parts being mutually exclusive.

7. A device as claimed in claim 2, wherein a page picture, including a set of pixels displayed in said two-dimensional area, is displayed in accordance with a picture pattern with at least two interlaced fields, and wherein said generating means comprises a memory which is addressed in phase with the period in which an m-bit information word is presented to said gate circuit and with the period of a picture pattern in order to generate second and third control signals during these periods.

8. A device as claimed in claim 2, wherein a page picture, including a set of pixels displayed in said two-dimensional area, is displayed in accordance with a picture pattern with at least two interlaced fields, and wherein said generating means comprises a memory which is addressed in phase with the period in which an m-bit information word is presented to said gate circuit or with the period of a picture pattern in order to generate second and third control signals during these periods.

* * * * *